US011313116B2

(12) United States Patent
Eggleston, II et al.

(10) Patent No.: US 11,313,116 B2
(45) Date of Patent: Apr. 26, 2022

(54) STACKABLE BAFFLE DROP SHAFT UNIT AND METHOD

(71) Applicants: Richard J. Eggleston, II, Asotin, WA (US); Guy A. Conversano, Ellensburg, WA (US)

(72) Inventors: Richard J. Eggleston, II, Asotin, WA (US); Guy A. Conversano, Ellensburg, WA (US)

( * ) Notice: Subject to any disclaimer, the term of this patent is extended or adjusted under 35 U.S.C. 154(b) by 0 days.

(21) Appl. No.: 16/918,585

(22) Filed: Jul. 1, 2020

(65) Prior Publication Data

US 2021/0002885 A1 Jan. 7, 2021

Related U.S. Application Data

(60) Provisional application No. 62/869,381, filed on Jul. 1, 2019.

(51) Int. Cl.
*E03F 1/00* (2006.01)

(52) U.S. Cl.
CPC ..... *E03F 1/005* (2013.01)

(58) Field of Classification Search
CPC . E03F 1/003; E03F 1/005; E03F 5/022; E03F 5/027; E02D 29/12
See application file for complete search history.

(56) References Cited

U.S. PATENT DOCUMENTS 4,023,590 A * 5/1977 Harris ..... E02D 29/12 137/363
5,271,193 A * 12/1993 Olsen ..... B28B 7/38 52/169.7
5,482,400 A * 1/1996 Bavington ..... E02D 29/12 404/25
5,613,806 A * 3/1997 House ..... E02D 29/12 138/97
7,186,058 B2 * 3/2007 Schluter ..... E03F 5/101 405/39
7,223,051 B1 * 5/2007 Vought ..... E02D 29/12 405/154.1

(Continued)

OTHER PUBLICATIONS

Odgaard, et al; Baffle-Drop Structure Design Relationships; 2013; All (Year: 2013).*

(Continued)

*Primary Examiner* — Benjamin F Fiorello
(74) *Attorney, Agent, or Firm* — Randall Danskin P.S.

(57) ABSTRACT

A stackable baffle drop shaft unit and method provides a pre-cast body that has a peripheral wall extending thereabout and having a top edge and an opposing bottom edge, the peripheral wall has an exterior facing surface and an opposing interior facing surface, and the body defines a medial channel extending therethrough between the top edge and the bottom edge. A baffle is carried by, and extends inwardly from the interior facing surface and partially across the medial channel defined by the body, and the baffle is positioned between the top edge and the bottom edge. The top edge and the bottom edge of the pre-cast body each define a portion of a positionally securing engagement and alignment means for positional and vertical alignment and stacking of plural units on top of one another. Vertical stacking of plural bodies forms a medial channel extending therethrough.

12 Claims, 11 Drawing Sheets

(56) References Cited

U.S. PATENT DOCUMENTS

| | | | | |
|---|---|---|---|---|
| 8,034,238 | B2 * | 10/2011 | Ghalib | C02F 1/006 210/170.03 |
| 9,249,566 | B2 | 2/2016 | Eggleston, II et al. | |
| 9,328,500 | B2 * | 5/2016 | Chai | B01D 17/0211 |
| 10,500,760 | B2 | 12/2019 | Eggleston, II | |
| 2002/0139736 | A1 * | 10/2002 | Stever | B01D 21/307 210/170.03 |
| 2008/0047886 | A1 * | 2/2008 | Lambert | E03F 1/002 210/163 |
| 2011/0253238 | A1 * | 10/2011 | Burkhart, Sr. | E03F 1/005 137/580 |
| 2013/0336723 | A1 * | 12/2013 | McKinney | E02D 29/121 405/129.55 |
| 2018/0135292 | A1 * | 5/2018 | Zarraonandia | E03F 1/005 |

OTHER PUBLICATIONS

Domenick et al.; The Blacklick Creek Sanitary Interceptor Sewer; Ohio Water Environment Association; May 2018 (Year: 2018).*

Dahir et al.; "Replacement of the Spiral Drain at the North End of UBC Campus"; Apr. 2017; All pages (Year: 2017).*

Design Computations for Blacklick Creek BCSIS Section 6 Parts B&C 14 Foot Diameter Manhole Columbus, Ohio. (Publication Date: unknown). (Obtained by Inventor: Jul. 15, 2020).

* cited by examiner

STACKABLE BAFFLE DROP SHAFT UNIT AND METHOD

RELATED APPLICATIONS

This US Utility Patent Application claims priority to earlier filed, U.S. Provisional Patent Application No. 62/869,381 filed on 1 Jul. 2019 and titled STACKABLE BAFFLE DROP SHAFT UNIT AND METHOD. The entire contents and disclosure of earlier filed U.S. 62/869,381 is fully incorporated herein to the same extent as if directly included herein.

Pursuant to USPTO rules, priority is also claimed to said earlier filed U.S. 62/869,381 in the Application Data Sheet (ADS) filed herewith.

FIELD OF INVENTION

The present invention relates to tunnels and shafts. More particularly, the present invention relates to stackable bodies for forming a shaft. Each stackable body is pre-cast and has a peripherally extending wall with an exterior facing surface and an opposing interior facing surface. Each body defines a medial channel extending therethrough and each body has a baffle that at least partially occludes a defined medial channel and plural bodies are stackable vertically to provide a shaft having a continuous medial channel extending therethrough and extending between a first level and a second level.

BACKGROUND

Many construction projects including, but not limited, to wastewater handling, storm water handling, underground water storage and pumping stations of new construction or retro-fit/remodeling have a need for vertical shafts for transferring surface water to underground storage caverns, for delayed/controlled processing, for ingress and egress of personnel, and/or service equipment such as, but not limited to, communication, plumbing and electrical.

In such construction projects, it is common to bore/Install large diameter pipes/channels/shafts (herein after "shafts") generally vertically into the earth so that the shafts communicate from a first level such as the surface to a second level such as an underground wastewater storage cavern. The shafts allow surface wastewater and storm water to flow unimpeded through these pipes/channels/shafts and enter the storage caverns. However, it has been determined that uncontrolled and unimpeded flows of large volumes of wastewater and storm-water has detrimental effects including, but not limited to causing cracks/fractures in the related structures and containment means due to extreme pressures and excessive friction. Further, unimpeded and uncontrolled flow of such large volumes of water generates excess oxygen levels in the water which causes the water to be dangerously chemically reactive and corrosive which responsively leads to added excessive wear/aging/damage of the structures and equipment.

It has been determined that breaking, or partially impeding the uninterrupted flow of storm water and waste water from the surface, to the storage cavern by use of vertically spaced apart baffles in the shaft can reduce or eliminate the detrimental effects of the chemically reactive water, and damage caused by the weight of the vertical drop of water and stresses and erosion caused thereby.

It is known in the construction industry for shafts and towers to be either "cast in place" or formed using "precast planar wall panels" that are attached to one another "in-situ" to form the shaft.

Generally, shafts are formed by excavating/boring the shaft and then establishing a supporting foundation at the lowest level, and then constructing the shaft/tower vertically upwardly from the foundation.

When the "cast in place" method is used, a shaft is excavated in the ground and movable, spaced apart forms are positioned to form an interior facing surface of a shaft/tower wall and also at a position to form an exterior facing surface of the shaft/tower wall. Reinforcing elements such as steel, and/or rebar may be added to the space between the forms and concrete is then poured into the space defined between the forms and about the reinforcing elements. As the concrete at the lowest levels cures/hardens, the forms are moved and repositioned upwardly and more reinforcing is added and more concrete is poured. The process is repeated/continued until the desired uppermost level is formed. This "cast in place" method is complex and time consuming, especially when a below grade shaft is being formed because a shaft requires workers to be within the shaft to position and move the forms, install the reinforcing, pour the concrete, and all of the construction materials must be lowered down the shaft from above while the workers are within the shaft. After the shaft/tower is complete, additional structures, such as baffles may be added to interior shaft walls by attaching fastening means to the interior shaft walls and thereafter attaching the baffles to the fastening means after lowering the baffles down the shaft from above.

When the pre-cast planar wall panel method/process is used to construct a below grade shaft, the pre-cast planar wall panels are hoisted with a crane and lowered into the defined shaft and positioned one at a time upon the foundation and fastened thereto. Thereafter, additional pre-cast planar wall panels are fastened to the previously installed pre-cast wall panels along immediately adjacent edge portions. This method is also complex, dangerous and time consuming because it requires workers to be within the shaft to position and align the pre-cast planar wall panels, to support the pre-cast wall panels while the level is completed, to interconnect the panels together, to caulk or otherwise seal the joints between the adjacent panels and all of the construction materials must be lowered down the shaft from above while the workers are within the shaft. If weld-plates are used as a fastening means, each of the pre-cast planar wall panels generally carries at least one weld-plate at each end portion and at top and bottom portions that are positioned immediately adjacent similar weld-plates carried by immediately adjacent pre-cast wall panels when the wall panel is properly positioned. The weld-plates are "welded" together to provide additional strength and integrity between the adjacent wall panels. Unfortunately, the welding of weld plates may require workers to access both the interior and exterior portions of the pre-cast planar panels within the shaft. Welding also generates noxious/poisonous gases/fumes that need to be ventilated out of the shaft, necessitating more/additional equipment and further limiting working space. The weld plates also add complexity to the pre-casting of the planar wall panels as the weld plates must be correctly positioned within the forms prior to the concrete being poured into the forms, and the "bonding" of metal to concrete can be problematic as such interfaces are subject to corrosion, chemical reactions and the like that can, over time, weaken the concrete proximate to the metal weld plate and/or weaken the metal comprising the weld plate and/or weaken the weld interconnecting the adjacent weld plates. This is particularly important in light of the fact the oxygenated water is so chemically reactive. Further still, planar wall panels necessitate joints therebetween which have less structural integrity/are weaker and are more subject to breaking/leaking/fracturing. It is also recognized that square or otherwise substantially rectilinear bodies are more susceptible to breaking under pressure as the pressure tends to concentrate at joints/corners. Therefore, annular or rounded or polygonal configurations are preferable.

Known methods for forming such baffle shafts are complex, dangerous to workers, expensive and time consuming. In the situations where a shaft is being constructed below grade, "shoring" and support must be installed and maintained throughout the length of the shaft for the duration of the project to prevent collapse of the surrounding earth defining the shaft. There may also be a need for a temporary elevator or lift for workers to reach the work site inside the shaft such as to move the forms and weld the weld-plates to one another. After the shaft is complete, workers must seal/caulk the joints between the adjacent panels and install the baffles and access means within the shaft by attaching fasteners to inside walls of the shaft at specified locations, and thereafter attaching the baffles and access means to the fasteners which are lowered down the shaft from above. This work is hazardous as the baffles must be lowered down the shaft from above while the workers are within the shaft. Further yet, the "hole" in which the shaft is constructed may need to be larger than the ultimate finished shaft size.

The instant invention overcomes various of the aforementioned drawbacks to known construction methods and apparatus for baffles drop shafts by providing a precast, stackable, peripherally defined unit having a peripherally extending wall that defines a medial channel extending therethrough. Each stackable unit may carry a preinstalled generally horizontally extending baffle within the channel defined by the peripherally extending wall. A locking protrusion and a locking recess may be defined in vertically opposing top and bottom portions of each stackable unit to facilitate positional securement and alignment as additional units are stacked on top of one another providing a plurality of vertically spaced apart and preinstalled baffles within the medial channel. Because each body is integral, having a peripherally extending wall and possibly also an integral medial divider wall, the thickness of the peripheral walls may be reduced while maintaining necessary strength and rigidity and reducing weight. Because each body is similar, the concrete forms for casting the bodies are all the same. Horizontal seams between immediately adjacent bodies may carry a pre-installed pliable sealant such as, but not limited to butyl tape which provides a fluid tight seal between immediately adjacent bodies. Weight of the stacked bodies compresses the pliable sealant which may be applied to an upper and/or lower surface edge of each body prior to installation further reducing labor costs and time.

Further still, because there is only a limited need for workers to physically access and work on the exterior surface portions of the body's during installation, the shaft may be smaller further reducing time and associated costs. Because the baffles may be preinstalled, or integrally formed, within the medial channel defined by each body as the bodies are stacked upon one another there is no need to separately install the baffles which even further reduces costs and installation time.

Some or all of the problems, difficulties and drawbacks identified above and other problems, difficulties, and drawbacks may be helped or solved by the inventions shown and described herein. The instant invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel inventions shown and described herein.

BRIEF SUMMARY OF THE INVENTION

A baffle drop shaft unit and method for impeding uncontrolled gravitational flow of water from a first level to a second lower level generally provides a pre-cast body having a peripheral wall extending thereabout, a top edge, a bottom edge, an exterior facing surface, an interior facing surface and the pre-cast body defines a medial channel between the top edge and the bottom edge; a baffle having a top surface, a bottom surface and a terminal edge, the baffle extending inwardly from the interior facing surface of the pre-cast body to at least partially occlude the medial channel, and the baffle is positioned relative to the pre-cast body at or below, the top edge, or at or above, the bottom edge; the top edge and the bottom edge of the pre-cast body each form a portion of a positionally securing engagement and alignment means for positional and vertical alignment and stacking of plural pre-cast bodies on top of one another; and an inlet port defined in a first pre-cast body and communicating between the exterior facing surface and the interior facing surface spacedly above the baffle within the medial channel, the inlet port communicating with a source of water proximate the first level; and an outlet port defined in a second pre-cast body and communicating between the interior facing surface and the exterior facing surface, the outlet port communicating with an outlet conduit proximate the second level which is vertically lower than the first level.

A further aspect of the present invention provides a divider wall extending diametrically across the medial channel and between the top edge and the bottom edge dividing the medial channel into a dry side and a wet side; and the baffle is on the wet side of the medial channel.

A further aspect of the present invention provides plural bodies vertically stacked on top of one another with the bottom edge of a first vertically upper pre-cast body immediately adjacent to and frictionally engaged with a top edge of an immediately adjacent second vertically lower pre-cast body to form a medial channel extending axially through the plural vertically stacked pre-cast bodies.

A further aspect of the present invention provides a base unit interconnected to the plural stacked pre-cast bodies at a vertically lowermost position relative to the plural stacked pre-cast bodies, the base unit having an integral bottom that fully occludes the medial channel; and defining an outlet port for water to exit the baffle drop.

A further aspect of the present invention provides a pre-cast body that is cast in multiple individual body pieces, each individual body piece having a first edge and a spaced apart second edge, and the plural individual body pieces are interconnected to one another edge-to-edge to form a single pre-cast body having a peripheral edge extending entirely thereabout and having both the exterior facing surface and the interior facing surface of the peripheral wall and defining the medial channel.

A further aspect of the present invention provides a pre-cast body is cast as a single piece off site, and is transported to an installation site.

A further aspect of the present invention provides a pre-cast body is pre-cast in multiple individual body pieces off site and the multiple individual body pieces are transported to an installation site for assembly and installation.

A further aspect of the present invention provides a pre-cast body is at least partially annular in peripheral configuration.

A further aspect of the present invention provides a pre-cast body that is at least partially polygonal in peripheral configuration.

A further aspect of the present invention provides worker access apparatus such as, but not limited to, stairs within the dry side of the medial channel.

A further aspect of the present invention provides plural pre-cast bodies that are substantially identical, and the position of the baffle within the wet side of the medial channel is alternated by inverting each of the plural pre-cast bodies relative to the immediately vertically below pre-cast body.

A further aspect of the present invention provides a stackable baffle drop shaft unit for impeding uncontrolled gravitational flow of water from a first level to a second lower level, comprising: plural pre-cast bodies vertically axially aligned and interconnected with one another, each of the plural pre-cast bodies having a peripheral wall extending thereabout, and each pre-cast body has a top edge, a bottom edge, an exterior facing surface, an interior facing surface and defines a medial channel between the top edge and the bottom edge, so that the plural interconnected pre-cast bodies define a medial channel extending therethrough; a top interconnected with the top edge of an uppermost of the plural pre-cast bodies, the top substantially completely occluding the medial channel at the top edge of the uppermost pre-cast body; a base unit interconnected to the plural vertically stacked pre-cast bodies at a vertically lowermost position relative to the plural stacked pre-cast bodies, the base unit having an integral bottom that fully occludes the medial channel; a divider wall extending diametrically across the medial channel of each of the plural pre-cast bodies and between the top edge and the bottom edge so as divide the medial channel into a dry side and a wet side; worker access apparatus within the medial channel on the dry side; a baffle on the wet side of the medial channel, the baffle having a top surface, a bottom surface and a terminal edge, the baffle extending inwardly from the interior facing surface of the pre-cast body and extending at least partially across the medial channel defined by the pre-cast body to at least partially occlude the medial channel, and the baffle is positioned relative to the body at or below, the top edge, or at or above, the bottom edge; the top edge and the bottom edge of the pre-cast body each form a portion of a positionally securing engagement and alignment means for positional and vertical alignment and stacking of plural pre-cast bodies on top of one another; and an inlet port defined in at least one body and communicating between the exterior facing surface and the interior facing surface spacedly above the baffle within the medial channel, the inlet port communicating with a source of water proximate the first level; and an outlet port defined in at least one body and communicating between the interior facing surface and the exterior facing surface, the outlet port communicating with an outlet conduit proximate the second level which is vertically lower than the first level.

A still further aspect of the present invention provides a method for forming a baffle drop assembly comprising the steps defining a shaft in a supporting ground surface, the shaft having a first level proximate a ground level and proximate a source of water; and a second level vertically lower than the first level, the second level proximate a water storage space, and the shaft having a predetermined interior diameter; establishing a foundation within the shaft at the second level, the foundation being sufficient to operationally support the baffle drop assembly and water to be received therein; providing a base unit for the baffle drop assembly, the base unit having a peripheral wall that extends entirely there-about, and an exterior diameter that is less than the diameter of the defined shaft, the peripheral wall having a top edge, a bottom edge, an exterior facing surface, an interior facing surface, and the peripheral wall defines a medial channel, having an interior diameter that is fully occluded by a bottom of the base unit proximate the bottom edge thereof, the base unit further defining an outlet port that communicates between the interior facing surface and the exterior facing surface proximate the bottom so that water within the base unit flows outwardly through the outlet port which communicates with an outlet conduit that communicates with a fluid storage space; providing a first baffle drop body, the first baffle drop body having a peripheral wall that extends entirely there-about, with an exterior diameter that is the same as the exterior diameter of the base unit, the peripheral wall having a top edge, a bottom edge, an exterior facing surface, an interior facing surface, and the peripheral wall defines a medial channel that extends between the top edge and the bottom edge, and the bottom edge of the first baffle drop body is aligned with, and positioned immediately adjacent, the top edge of the bottom unit, and the first baffle drop body has a generally horizontally and laterally extending baffle extending inwardly from the interior facing surface of the peripheral wall to at least partially occlude the medial channel defined by the first baffle drop body, and the first baffle drop body has a diametrically extending divider wall within the medial channel and extending from the top edge to the bottom edge to divide the medial channel into a dry side and a wet side, and wherein the baffle is within the wet side, and worker access means are within the dry side, and securing the bottom edge of the first baffle drop body to the top edge of the base unit in a substantially fluid tight interconnection; providing a second baffle drop body that is substantially identical to the first baffle drop body and inverting the second baffle drop body relative to the first baffle drop body, the second baffle drop body having a peripheral wall that extends entirely there-about, with an exterior diameter that is the same as the exterior diameter of the first baffle drop body, the peripheral wall having a top edge, a bottom edge, an exterior facing surface, an interior facing surface, and the peripheral wall defines a medial channel that extends between the top edge and the bottom edge, and the bottom edge of the second baffle drop body is aligned with and positioned immediately adjacent the top edge of the first baffle drop body, and the second baffle drop body has a generally horizontally and laterally extending baffle extending inwardly from the interior facing surface of the peripheral wall to at least partially occlude the medial channel defined by the second baffle drop body, and the second baffle drop body has a diametrically extending divider wall within the medial channel and extending from the top edge to the bottom edge to divide the medial channel into a dry side and a wet side, and wherein the baffle is within the wet side, and worker access means are within the dry side, and securing the bottom edge of the second baffle drop body to the top edge of the first baffle drop body in a substantially fluid tight interconnection, and the baffle carried within the second baffle drop body is both vertically and horizontally offset from the baffle carried within the wet side of the first baffle drop body; providing a third baffle drop body that is substantially identical to the second baffle drop body and inverting the third baffle drop body relative to the second baffle drop body, the third baffle drop body having a peripheral wall that extends entirely there-about, with an exterior diameter that is the same as the exterior diameter of the second baffle drop body, the peripheral wall having a top edge, a bottom edge, an exterior facing surface, an interior facing surface, and the peripheral wall defines a medial channel that extends between the top edge and the bottom edge, and the bottom edge of the third baffle drop body is aligned with and positioned immediately adjacent the top edge of the second baffle drop body, and the third baffle drop body has a generally horizontally and laterally extending baffle extending inwardly from the interior facing surface of the peripheral wall to at least partially occlude the medial channel defined by the third baffle drop body, and the third baffle drop body has a diametrically extending divider wall within the medial channel and extending from the top edge to the bottom edge to divide the medial channel into a dry side and a wet side wherein the baffle is within the wet side, and worker access means are within the dry side, and securing the bottom edge of the third baffle drop body to the top edge of the second baffle drop body in a substantially fluid tight interconnection, and the baffle carried within the wet side of the third baffle drop body is both vertically and horizontally offset from the baffle carried within the wet side of the second baffle drop body, and the baffle carried within the wet side of the third baffle drop body is vertically aligned with, but vertically spaced from, the baffle carried within the wet side of the first baffle drop body; defining an inlet port in the third baffle drop body, the inlet port communicating between the exterior facing surface and the interior facing surface proximate above the baffle so that water at the first level flows through the inlet port and into the medial channel of the third baffle drop body and onto the top surface of the baffle, and thereafter the water flows off the terminal edge of the baffle and falls downwardly along a flow window onto the top surface of the adjacent next below baffle and thereafter onto subsequent lower baffles; providing a top that is releasably interconnected with the top edge of the third baffle drop body proximate the first level, the top having a diameter that is substantially equal to the diameter of the third baffle drop body so that the top, when releasably engaged with the third baffle drop body substantially completely occludes the medial channel; and back-filling the defined shaft outward of the exterior facing surface of the peripheral wall.

In providing such a baffle drop shaft unit and method for impeding uncontrolled gravitational flow of water from a first level to a second lower level it is a principal aspect to provide pre-cast baffle drop shaft bodies that are vertically stackable upon one another to form a baffle drop shaft for storm water and waste water and sanitary purpose.

A further aspect is to provide a precast/preformed stackable baffle drop shaft unit that is formed in the shape of a partial polygon, and plural partial polygon shaped bodies may be joined together at adjacent edge portions to form a single baffle drop body shaft unit A further aspect is to provide a precast/preformed stackable baffle drop shaft unit that includes a diametrically extending wall that extends across the medial channel defined by the body.

A further aspect is to provide a precast/preformed stackable baffle drop shaft unit that is formed in the shape of a half annulus with a diametrically extending end wall.

A further aspect is to provide a precast/preformed stackable baffle drop shaft unit wherein the baffle occludes one half of the medial channel.

A further aspect is to provide a precast/preformed stackable baffle drop shaft unit wherein the baffle occludes less than one half of the medial channel.

A further aspect is to provide a precast/preformed stackable baffle drop shaft unit wherein the baffle occludes more than one half of the medial channel.

A further aspect is to provide a precast/preformed stackable baffle drop shaft unit that is formed in the shape of a partial annulus, and plural partial annulus shaped bodies may be joined together at adjacent edge portions to form a single baffle drop body shaft unit.

A further aspect is to provide a precast/preformed stackable baffle drop shaft unit and method that reduces installation time, minimizes onsite welding, and reduces sealing of joints.

A further aspect is to provide a precast/preformed stackable baffle drop shaft unit and method that may be aligned and interconnected by means including, but not limited to, grout sleeves, weld plates, aligned pegs and holes, adhesives, interlocking recesses and protuberances, keyways and it is contemplated that backfill may be used to stabilize and positionally secure the baffle drop.

A further aspect is to provide a precast/preformed stackable baffle drop shaft unit and method for use in mining, pumping stations, cooling towers, underwater construction, underground geothermal installations, and under-ground access chambers.

A further aspect is to provide a stackable baffle drop shaft unit and method that may be precast using molds and/or forms.

A further aspect is to provide a stackable baffle shaft drop unit that may be precast off-site and transported to an installation site.

A further aspect is to provide a stackable baffle drop shaft unit that may be precast on-site to eliminate transportation costs.

A further aspect is to provide a precast stackable baffle drop shaft unit and method having preinstalled access means such as, but not limited to, stairs.

A further aspect is to provide a stackable baffle drop body that is at least partially polygonal in configuration.

A further aspect is to provide a precast stackable baffle drop shaft unit and method for equipment and service shafts.

A still further aspect is to provide a precast stackable baffle drop shaft unit that is formed in plural pieces to facilitate transport, and the plural pieces are assembled on site to form a single unitary baffle drop shaft body.

Other and further aspects of the instant invention will appear from the following specification and accompanying drawings which form a part hereof. In carrying out the aspects of the invention it is to be understood that its structures and features and steps are susceptible to change in design and arrangement and order with only one preferred and practical embodiment of the best known mode being illustrated in the accompanying drawings and specified as is required.

BRIEF DESCRIPTION OF THE DRAWINGS

Preferred forms, configurations, embodiments and/or diagrams relating to and helping to describe preferred aspects and versions of the instant invention are explained and characterized herein, often with reference to the accompanying drawings. The drawings and features shown herein also serve as part of the disclosure of the invention, whether described in text or merely by graphical disclosure alone. The drawings are briefly described below.

DETAILED WRITTEN DESCRIPTION

Introductory Notes

Figure 1:
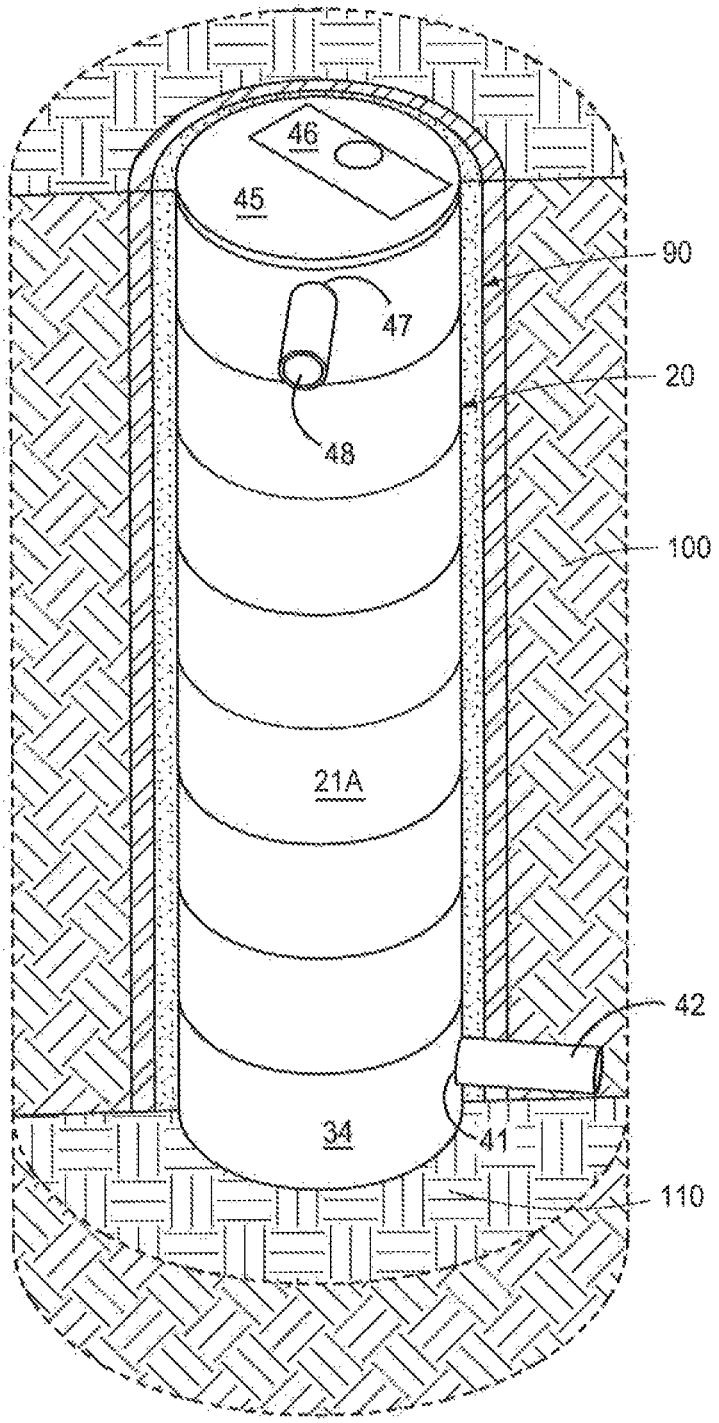
FIG. 1 is a perspective top and side view of an assembled cylindrical baffle drop surrounded by earth and showing inlet and outlet conduits.

The readers of this document should understand that dictionaries were used in the preparation of this document. Widely known and used in the preparation hereof *are The American Heritage Dictionary of the English Language*, (4th Edition© 2000), *Webster's New International Dictionary*, Unabridged, (Second Edition©1957), *Webster's Third New international Dictionary* (© 1993), *The Oxford English Dictionary* (Second Edition, ©1989), and *The New Century Dictionary* (©2001-2005), all of which are hereby incorporated by this reference for interpretation of terms used herein and to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both Claims and Abstract are incorporated by this reference into the description entirely.

As used herein, the term "lower", Its derivatives and grammatical equivalents refers to that portion of the instant precast stackable baffle drop shaft unit and method that is vertically proximate a foundation of a structure. It is expressly contemplated herein the foundation may be below ground surface level. The term "upper" Its derivatives and grammatical equivalents refers to that portion of the instant precast stackable baffle drop shaft unit and method that is vertically distal from the foundation.

A stackable baffle drop shaft unit for impeding uncontrolled gravitational flow of water from a first level to a second level generally provides a body 20 that is preferably formed of precast concrete, but may also be formed of other materials including, but not limited to, plastic, steel, stainless steel, alloys and/or composites. The body 20 may be annular or partially annular in configuration, but the body 20 is not limited to such annular or partially annular shape and may be of other shapes/configurations such as, but not limited to a polygon, or oval, or other geometric shape.

As shown in the Figures, the body 20 has a peripherally extending wall 21, a top edge 25, a bottom edge 26 and defines a medial channel 27 extending therethrough from the top edge 25 to the bottom edge 26. The peripherally extending wall 21 has an exterior surface designated by the letter "A" and an opposing interior surface designated by the letter "B".

Figure 2:
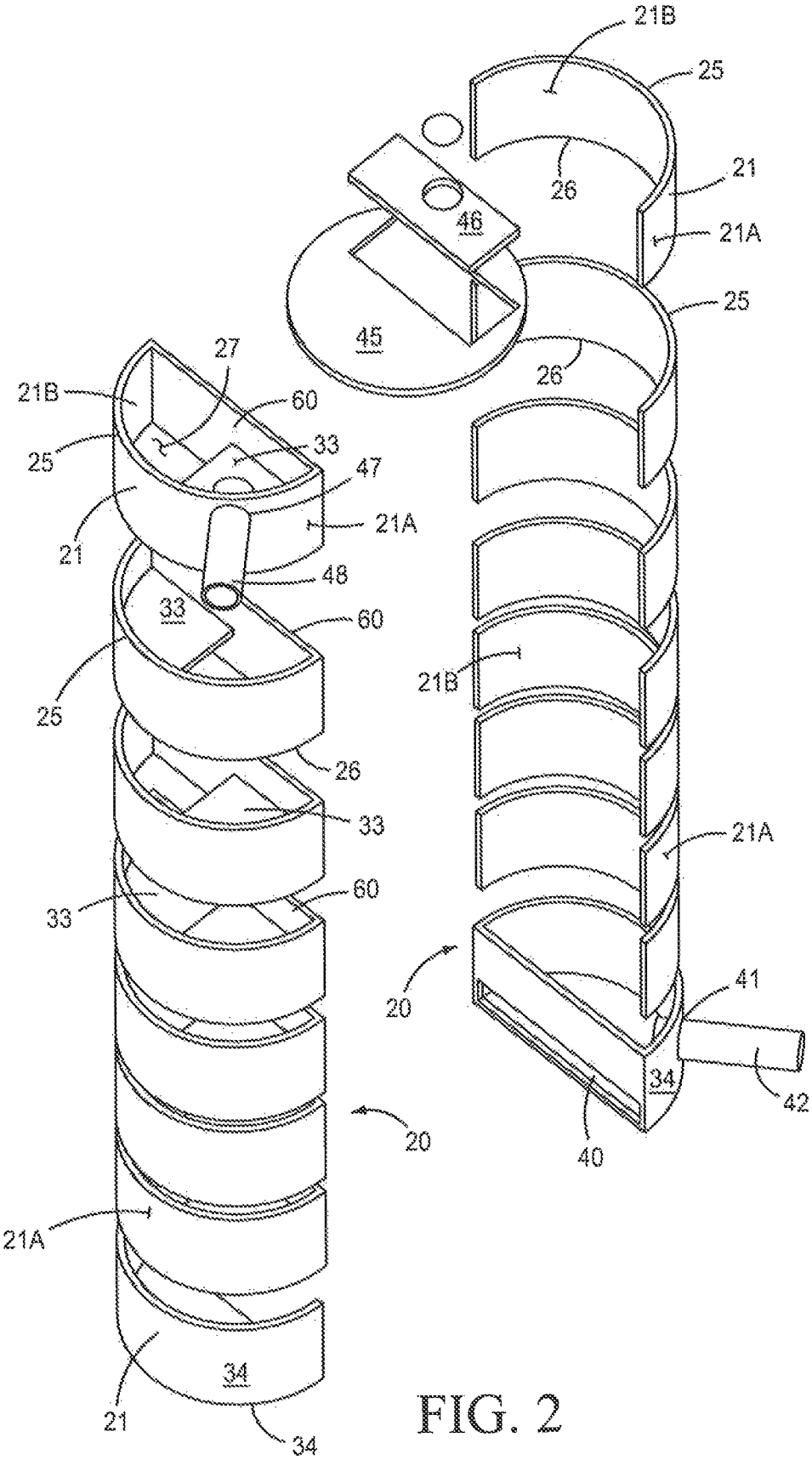
FIG. 2 is an exploded perspective top and side view of the cylindrical baffle drop of FIG. 1, showing each body formed of two half annular sections, one of each half annular sections for each body having a divider wall and a baffle, and a top and a base unit.
Figure 5:
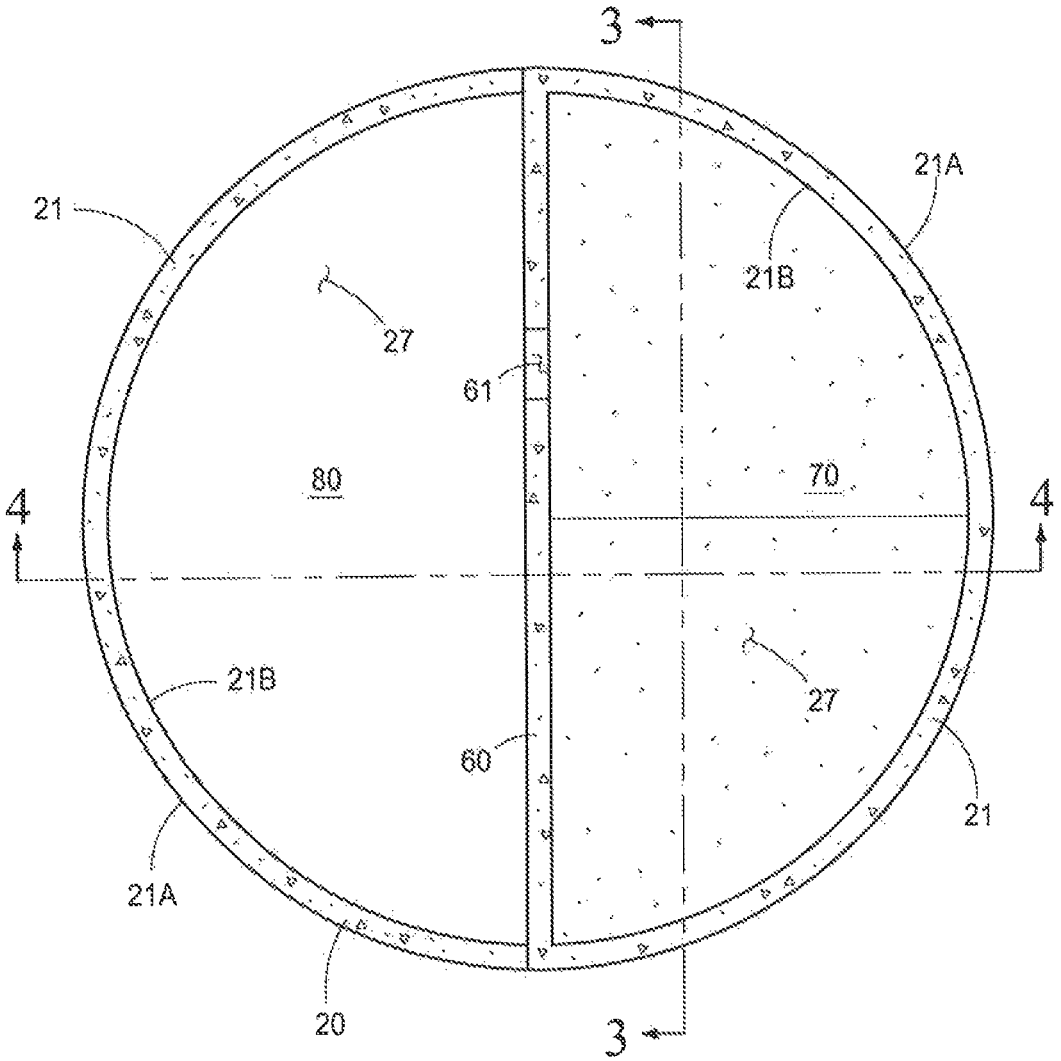
FIG. 5 is a plan view of the baffle drop of FIG. 4.

As shown in FIGS. 2 and 5 the body 20 may be divided in half by a divider wall 60 that extends diametrically across the medial channel 27 so that each body 20 defines a "wet side" 70 and a "dry side" 80. The divider wall 60 extends from the top edge 25 to the bottom edge 26. The wet side 70 includes a baffle 33 while the dry side 80 may not have a baffle 33 so that inspection and service equipment (not shown), such as, but not limited to stairs, ladders, pipes and lifts, may be installed therein.

Ventilation and viewing ports 61 may be defined in the divider wall 60 to provide visual or other inspection between the opposing sides 70, 80. As shown in the Figures, each body 20 carries a baffle 33 that is interconnected with the interior surface 21B of the peripheral wall 21 and extends inwardly therefrom so as to partially occlude the medial channel 27. If a divider wall 60 is present, the baffle 33 may also communicate with/be interconnected with an interior surface of the divider wall 60. Each baffle 33 has a top surface 33A, an opposing bottom surface 33B and a terminal edge 35. In the preferred embodiment, the baffle 33 is generally horizontal and parallel to the top edge 25 and bottom edge 26, but the orientation of the baffle 33 is not limited thereto, and the baffle 33 may also be oriented angularly, other than horizontal, relative to the top edge 25 and the bottom edge 26. Further still, the top surface 33A of the baffle 33 may be planar, or may also have a texture (not shown), including, but not limited to protuberances, to affect water flow there over.

Although the baffles 33 shown in the Figures are positioned generally medially between the top edge 25 and the bottom edge 26 of the body 20, it is contemplated the baffle 33, or plural baffles 33 may be positioned within the medial channel 27 adjacent the top edge 25, or adjacent the bottom edge 26, or at any position between the top edge 25 and the bottom edge 26.

Figure 8:
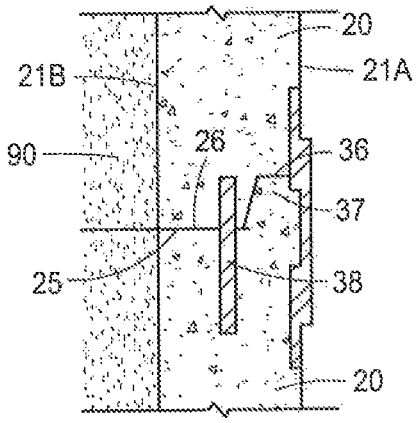
FIG. 8 is an enlarged orthographic cross sectional view of one contemplated alignment and attachment means showing dowels and aligned holes that may be used with the instant invention to align and join adjacent bodies.
Figure 9:
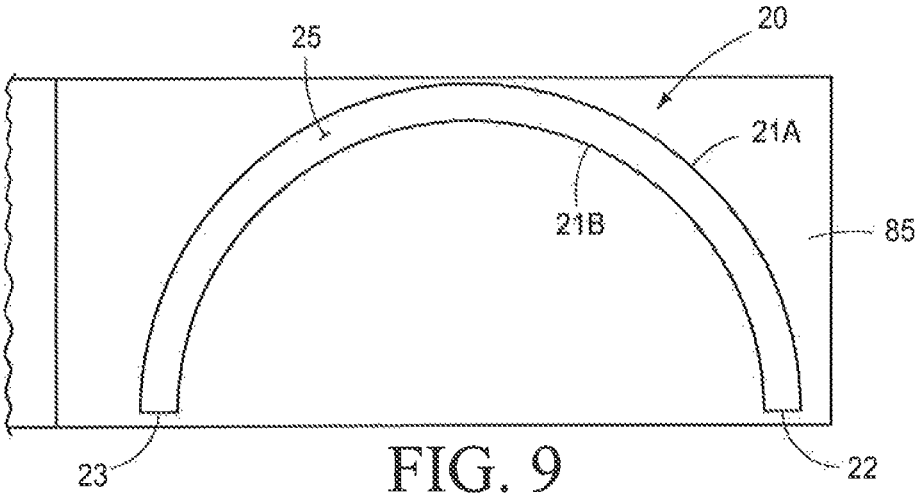
FIG. 9 is a plan view of a half annular piece of a cylindrical baffle drop body, less the dividing wall, carried on a trailer.
Figure 10:
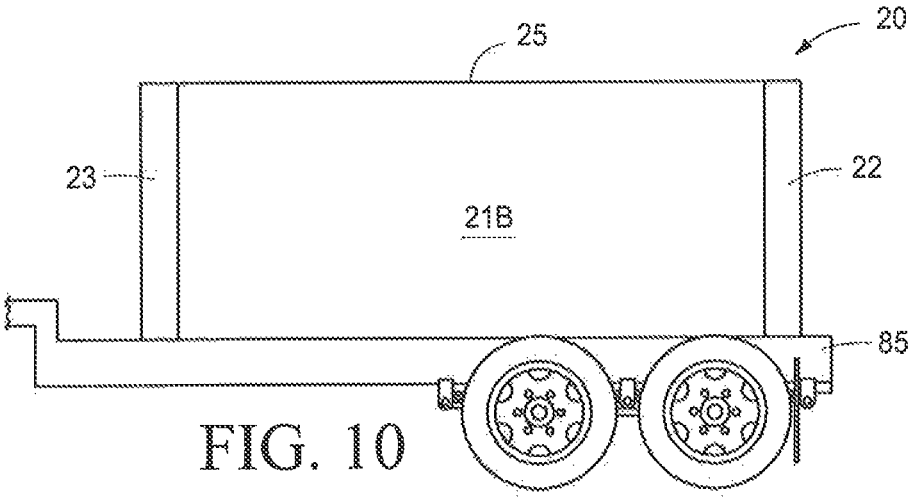
FIG. 10 is an orthographic side view of the half annular piece of a cylindrical baffle drop body of FIG. 9.
Figure 11:
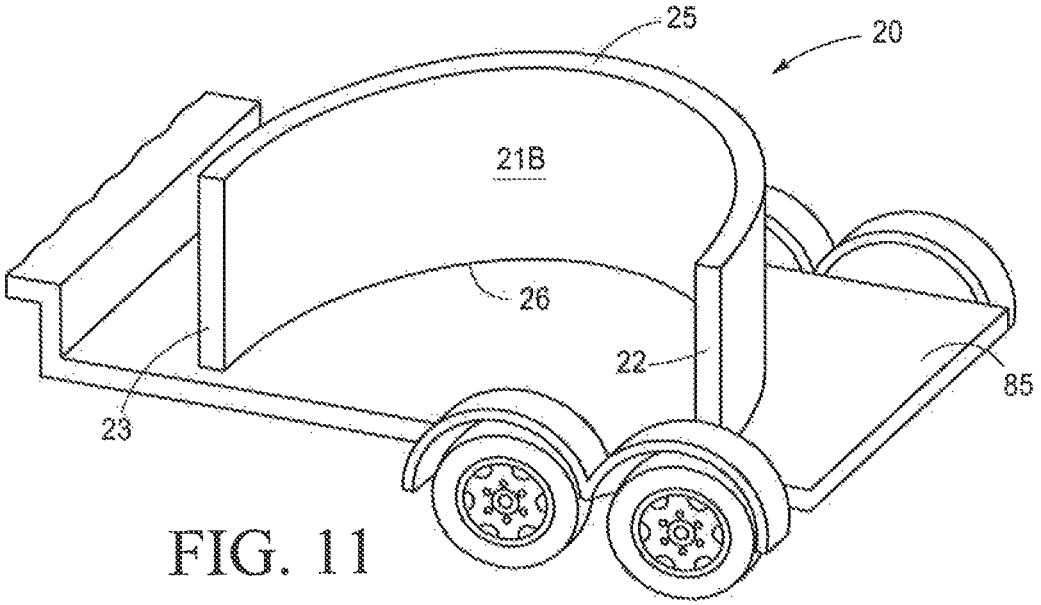
FIG. 11 is a perspective side, end and top view of the half annular piece of a cylindrical baffle drop body of FIG. 9.
Figure 12:
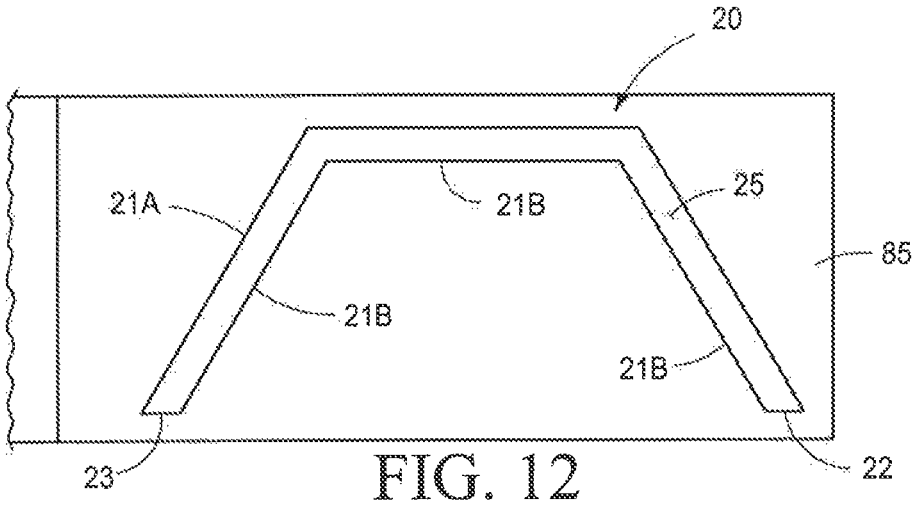
FIG. 12 is a plan view of a half polygon piece of a polygonal shaped baffle drop body, less the dividing wall, carried on a trailer.
Figure 13:
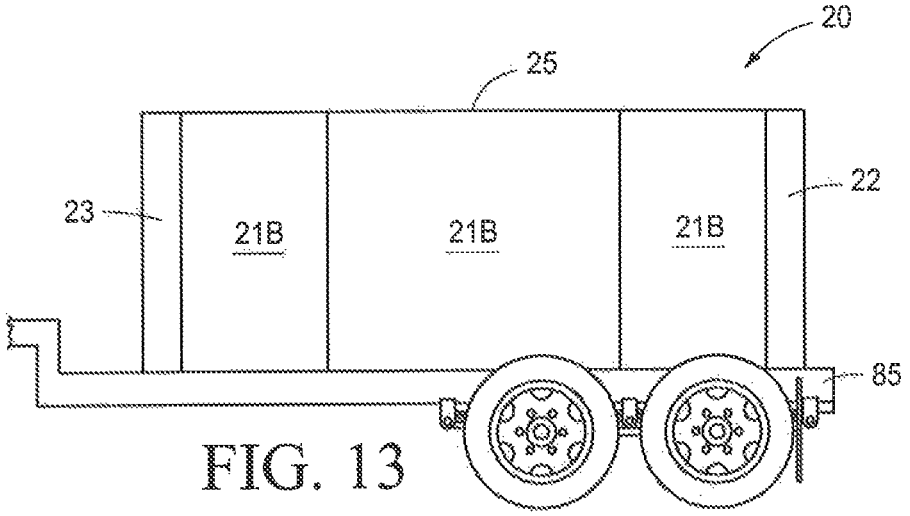
FIG. 13 is an orthographic side view of the half polygon piece of a polygonal baffle drop body of FIG. 12.
Figure 14:
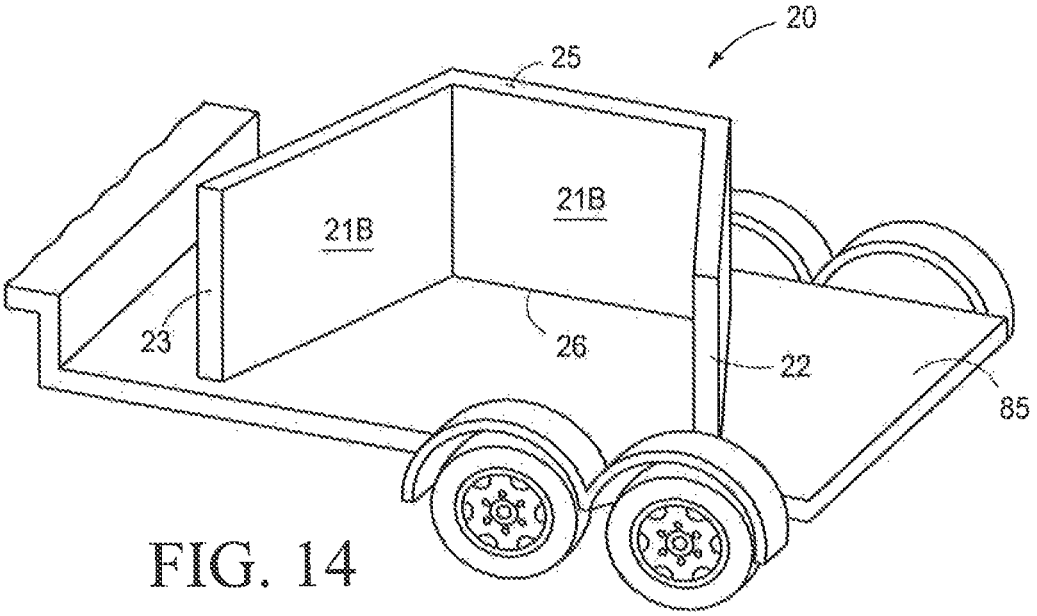
FIG. 14 is a perspective side, end and top view of the half polygon piece of a polygonal baffle drop body of FIG. 12.
Figure 15:
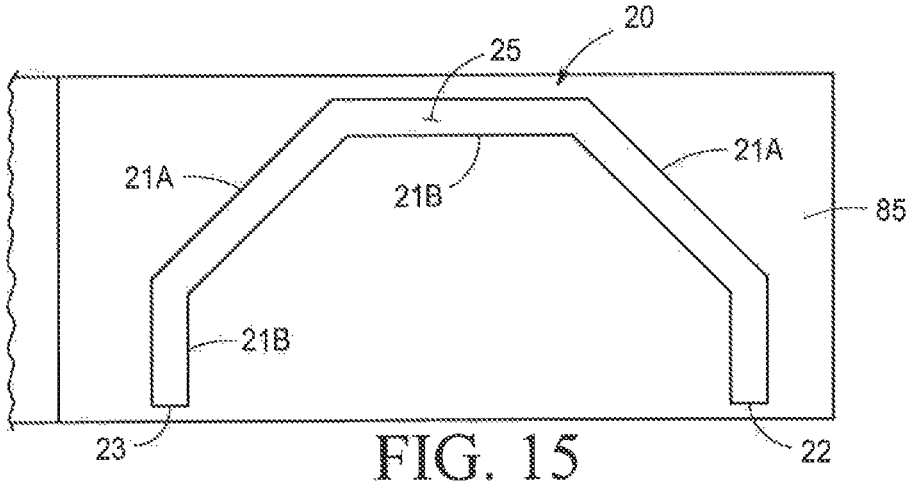
FIG. 15 is a plan view of a second half polygon piece of a polygon shaped baffle drop body, less the dividing wall, carried on a trailer.
Figure 16:
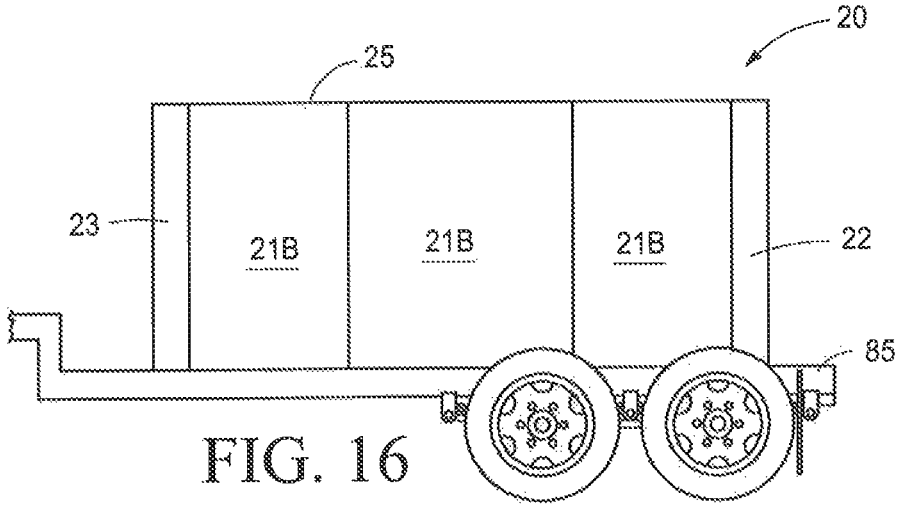
FIG. 16 is an orthographic side view of the second half polygon piece of a polygon baffle drop body of FIG. 15.
Figure 17:
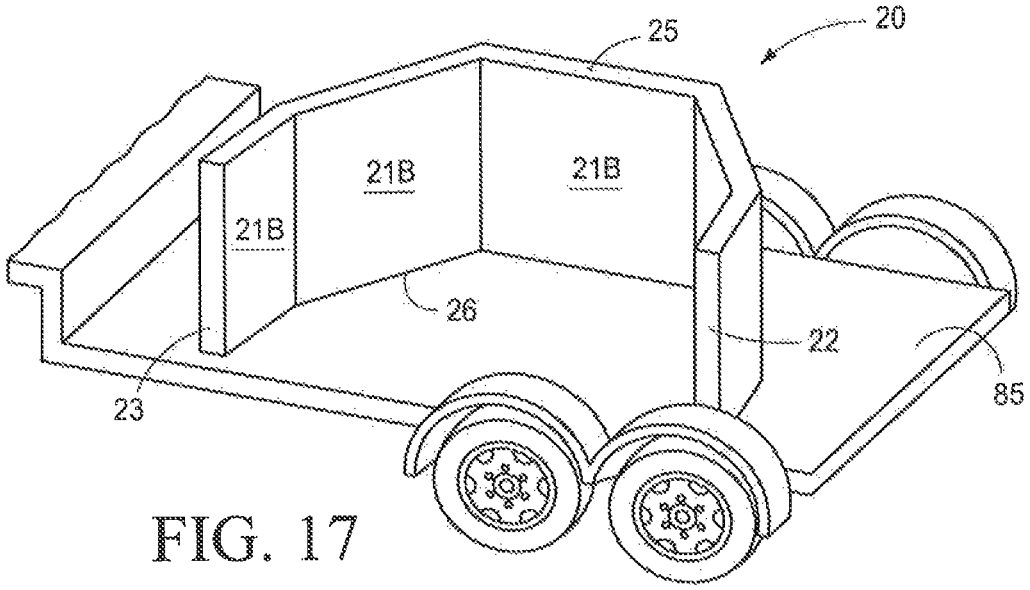
FIG. 17 is a perspective side, end and top view of the second half polygon piece of a polygon baffle drop body of FIG. 15.
Figure 18:
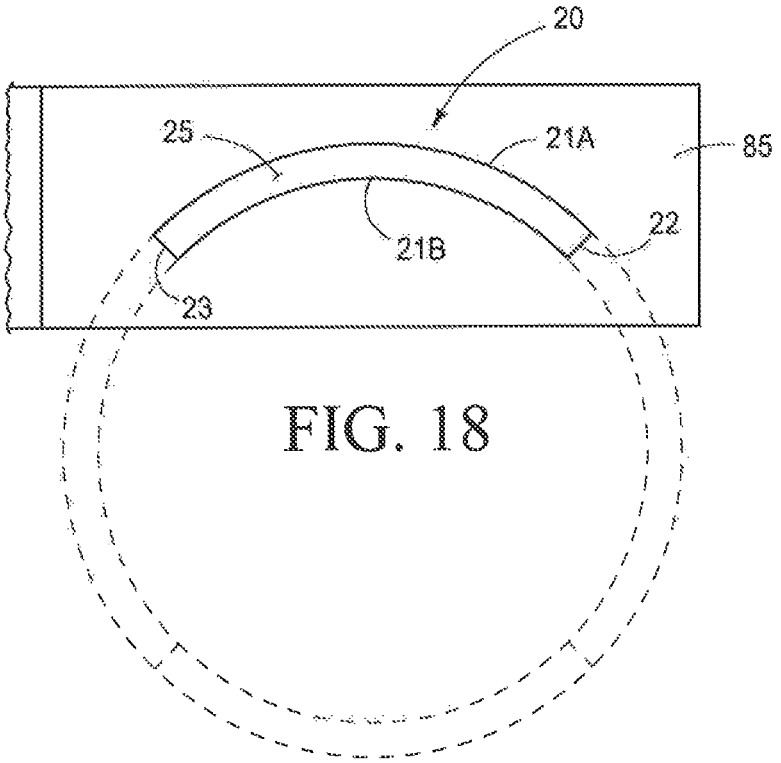
FIG. 18 is a plan view of a segment of a large, at last partially cylindrical shaped baffle drop body carried on a trailer, the majority portion of the large cylindrical shaped baffle drop body shown in phantom outline.
Figure 19:
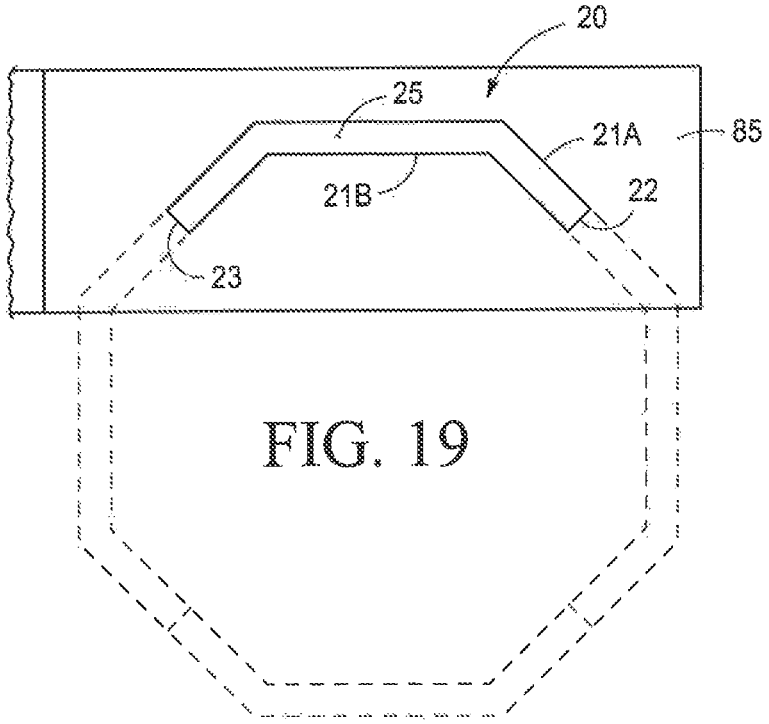
FIG. 19 is a plan view of a segment of a large polygon shaped baffle drop body carried on a trailer, the majority portion of the large polygon shaped baffle drop body shown in phantom outline.

As shown in FIG. 8, a locking recess 36 may be defined in the top edge 25 or in the bottom edge 26, and a locking protuberance 37 may be carried at the bottom edge 26, or at the top edge 25 the so that each body 20 has a portion of an engaging and alignment means at the top edge 25, and another portion of an engagement and alignment means at the bottom edge 26 to facilitate vertical stacking and alignment of the plural bodies 20. The carriage of such alignment and locking portions at the top edge 25, and the bottom edge 26 allows each and every body 20 to be similarly constructed using the same forms/molds and processes. Also as shown in the FIG. 8, an alignment dowel 36 may be carried in aligned holes (not shown) to enhance alignment and engagement of vertically adjacent bodies 20.

Dimensions and configurations of the possible alignment and attachment means (FIG. 8) may be altered and adjusted so as to allow one body 20 to securely engage with and be axially aligned with an immediately adjacent second body 20 when the bodies 20 are vertically and axially stacked. (FIGS. 1-4). Although the Figures show the bodies 20 as each having a generally annular, or half annular configuration, it is expressly contemplated that other configurations may likewise be employed, including but not limited to the configuration of a polygon with equally dimensioned opposing sides, and also, but not limited to, configurations wherein the side portions may be dissimilar in size and/or arc to one another.

Figure 6:
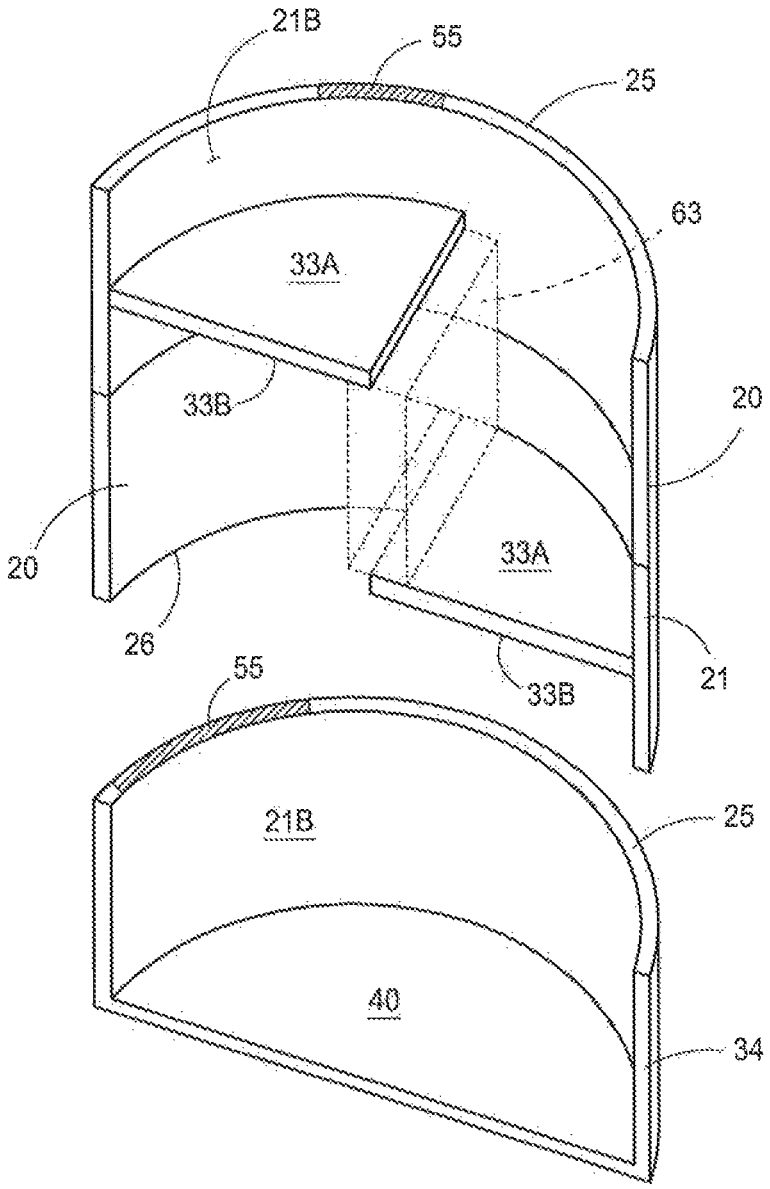
FIG. 6 is an exploded perspective sectional view of two stacked bodies body showing the baffles therein and the flow window, and the stacked bodies are axially aligned with a base section showing the interior of the bottom.
Figure 7:
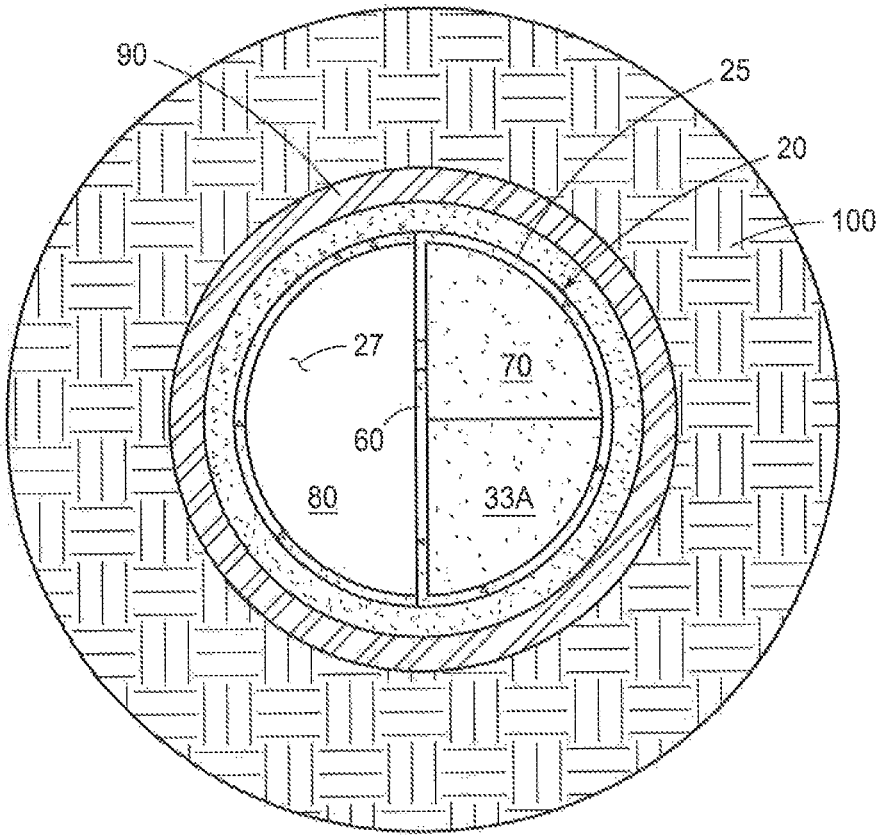
FIG. 7 is a plan view of the cylindrical baffle drop of FIG. 1, less the top, installed in the earth, showing the earth surrounding a caisson which is exterior to the baffle drop.

In one preferred embodiment, as shown in FIGS. 2 and 6, the bottom-most body 20, is a base unit 34 and does not define a medial channel 27 extending therethrough, but rather the base section 34 has a bottom portion 40 that entirely occludes the medial channel 27 adjacent to the bottom edge 26 of the base unit 34. The base unit 34 defines an outlet port 41 in the peripheral wall 21 which communicates with a discharge conduit 42 which communicates with the storage cavern (not shown) so that wastewater/storm water that cascades through the plural stacked bodies 20 of the baffle drop exits the baffle drop at the base section 34. Outlet port 41 may also be defined in bodies 20 other than the base unit 34.

As shown in FIG. 2, a top 45 may be removably secured to the top edge 25 of the uppermost body 20 to substantially completely occlude the top of the medial channel 27 and prevent unintentional access thereto. A door 46, or other controlled access port 46 may be defined in the top 45 to provide controlled access for inspection and the like.

As shown in FIG. 2, an inlet port 47, or plural inlet ports (not shown), may be defined in the peripheral wall 21 of at least one body 20 vertically above the base unit 34, which is not necessarily the uppermost body 20 due to elevations and topography. It is expressly contemplated that inlet ports 47 may be defined in multiple bodies 20 so as to provide the baffle drop with multiple inlet ports 47 for storm water/wastewater. The at least one inlet port 47 fluidically communicates with an inlet conduit 48 that communicates with a source of storm water/wastewater. (not shown). The source of the storm water/waste water is vertically proximate a first level while the discharge outlet 41 is vertically proximate a second level.

As shown in the Figures, plural bodies 20 are stacked on top of one another so that the medial channel 27 defined by each body 20 communicates with the medial channel 27 of an adjacent body 20 forming an elongated medial channel 27 extending therethrough. Weld plates (not shown), dowels 36 and aligning holes (not shown), keyways (not shown) and other known alignment means and attachment means may be carried at aligned positions on the top edge 25 and bottom edge 26 of each body 20 to provide additional attachment and alignment of the vertically adjacent bodies 20. (FIG. 8 shows one possible embodiment of an attachment/alignment means, but the means shown in FIG. 8 is expressly not a limitation.

A pliable sealant 55 such as, but not limited to butyl tape (not shown) may be applied to the top edge 25 and/or bottom edge 26 of each body 20 extending completely thereabout so that when a vertically adjacent body 20 is engaged therewith, the pliable sealant (not shown) is compressed therebetween providing a substantially fluid tight seal between the immediately adjacent bodies 20.

In the preferred embodiments, the instant stackable baffle drop shaft unit and the method is described as being used in wastewater and storm water storage and management facilities, including pump stations and mines, but it is contemplated that the instant stackable baffle drop shaft unit may also be used with a variety of other construction projects including new multiple story construction, retrofitting of multiple story construction, and even in under water projects such as, but not limited to, dams where dry access to a river bed or lake bed is required.

It is contemplated the bodies 20 may be precast at an off-site facility and transported to a use site for installation on a trailer 85. It is also contemplated, that forms and/or molds for casting the bodies 20 may be located on-site so that the bodies 20, or portions of the bodies 20, may be cast on-site (but not cast-in-place), such as in remote mining locations to eliminate transportation costs. It is further contemplated the baffles 33 may be cast integrally with the body 20, or otherwise formed separately from the body 20 and installed within the medial channel 27 after the body 20 is cast using fluid concrete and associated reinforcing steel. The bodies 20 are contemplated to be pre-cast using forms (not shown) and or molds (not shown) using precast techniques known to those in the art of concrete.

Operation

It is believed the instant invention, as described above, is readily apparent, however at this point applicants herein briefly provide a brief description of the operation of the current invention and method.

Plural bodies 20 need be available before installation would begin whether cast on-site or cast off-site and transported to the installation site on a trailer 85 or otherwise. If the bodies 20 are constructed from plural body pieces (FIGS. 9-19), opposing end portions 22, 23 of the plural body pieces are joined together by known means to form a unitary body 20 having a peripherally extending wall 21 extending thereabout, and defining the medial channel 27. If constructed from plural body pieces, the baffles 33 may be installed within the medial channel 27 and the divider wall 60 may likewise be installed within the medial channel 27 to form the wet side 70 and the dry side 80. Worker access means (not shown) may likewise be installed within the medial channel 27. A flexible sealant 55, such as but not limited to butyl tape is applied to the top edge 25 and bottom edge 26 of each body 20.

For a below grade installation, it Is contemplated a shaft would be excavated from the first level, which may be but is not necessarily the ground surface, using techniques known to those in the art of constructing shafts. The shaft would be appropriately "shored" to prevent collapse thereof, and that a foundation (not shown) would be constructed at the second level or bottom of the shaft. The foundation (not shown) need be sufficiently strong to vertically support the weight of plural vertically stacked bodies 20. After the foundation (not shown) is formed at the second level (bottom) of the shaft, a base unit 34 would be vertically lowered, by means of a crane or similar lifting apparatus, into the shaft defined in the earth to rest upon the previously constructed foundation (not shown) at the second level. After the base unit 34 is lowered into the shaft and interconnected with the foundation (not shown), and the bottom outlet port 41 is connected to the discharge conduit 42, additional bodies 20 are sequentially lowered into the shaft and positioned immediately adjacent the previously installed immediately lower body 20 so that the locking protrusion 37 and/or dowel 36 of the body 20 being lowered engages with the locking recess 36 and/or aligned hole (not shown) of the previously positioned body 20. The engagement of the lower edge 26 of a body 20 onto the top edge 25 of the adjacent lower body 20 will cause the pliable sealant 55 carried on the adjacent edges 25, 26 to be "crushed" and otherwise disbursed along the edges 25, 26 providing a seal between the immediately adjacent bodies 20. Any weld plates, (not shown) dowels 36, and aligned holes (not shown), keyways (not shown) and other known alignment/attachment means (not shown) used for alignment and structural integrity, may be welded from within the medial channel 27.

Figure 3:
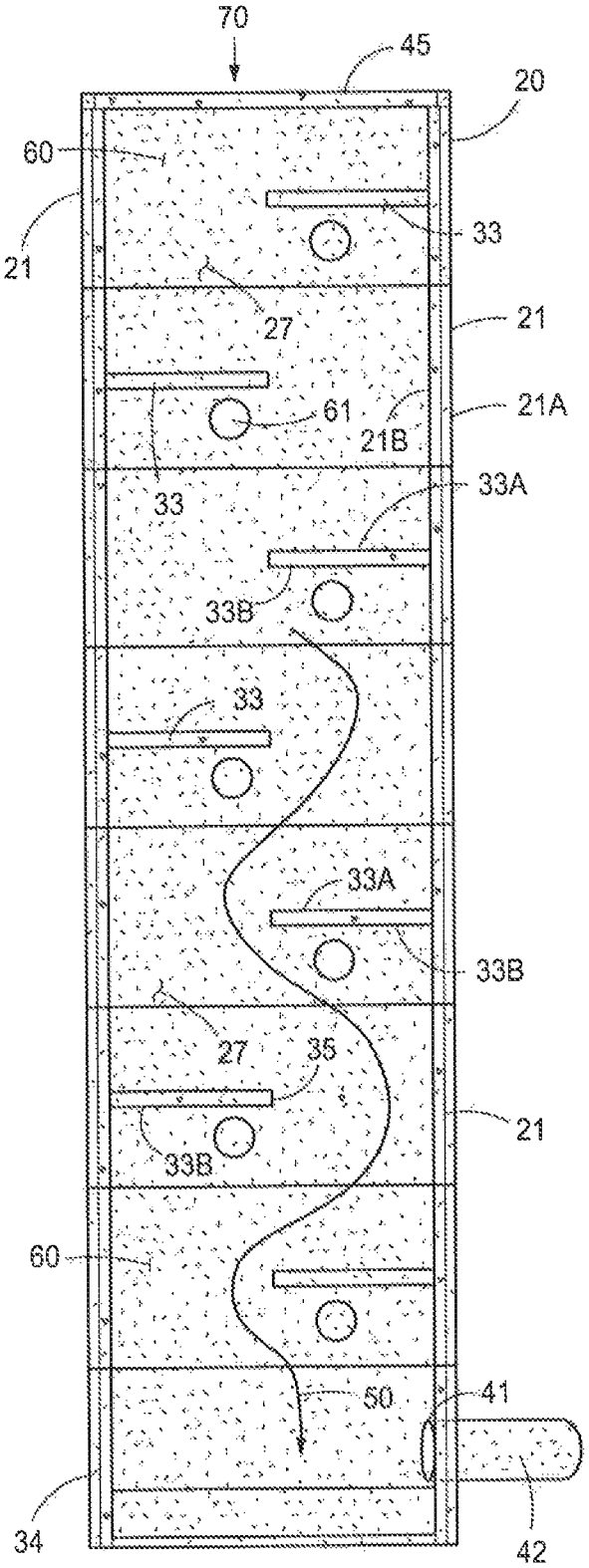
FIG. 3 is an orthographic vertical cross-sectional view of the cylindrical baffle drop, taken on line 3-3 of FIG. 5, showing the stair step orientation of the baffles within the medial channel defined by the vertically stacked bodies, and the generalized flow of water therethrough.
Figure 4:
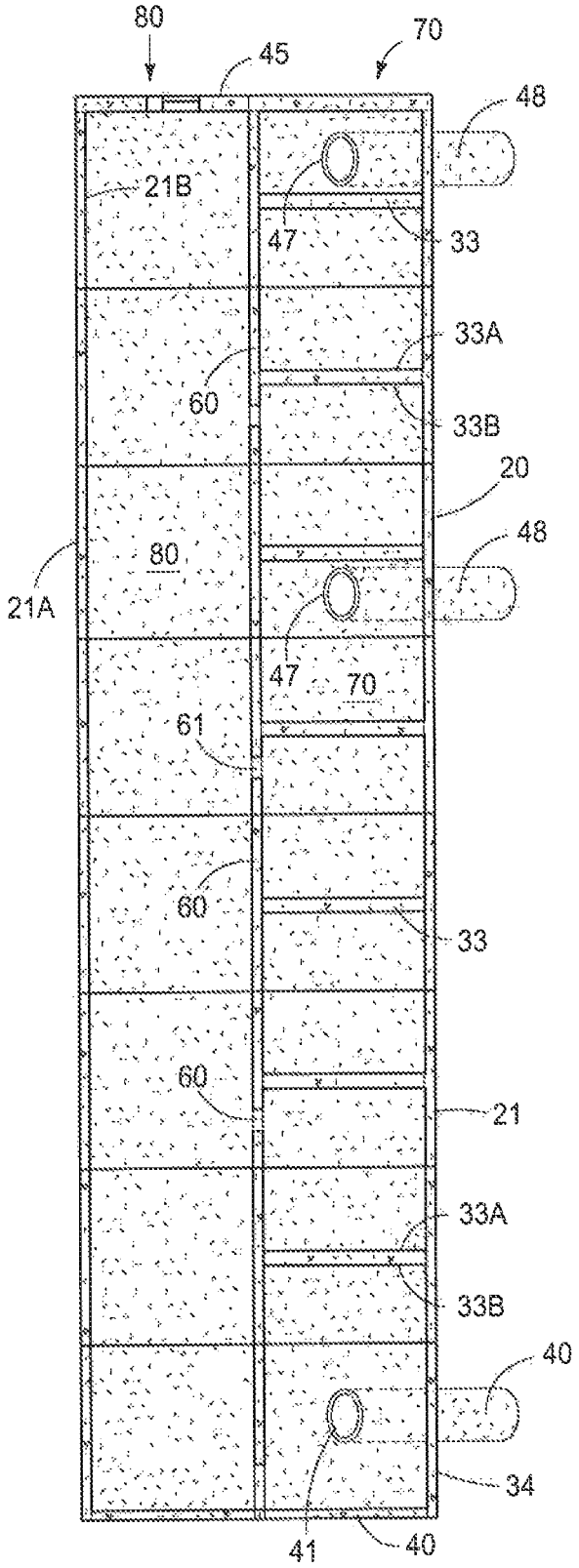
FIG. 4 is an orthographic vertical cross-sectional view of the baffle drop of FIG. 1, taken on line 4-4 of FIG. 5, and rotated axially 90° from the view shown in FIG. 3 to show the wet side and the dry side.

When the bodies 20 are substantially identical in configuration, such as when the bodies 20 are formed from similar/the same molds/forms, it may be necessary to invert each successive body 20 during installation in the shaft so that the baffles 33 are positionally alternated with each successive body 20 to create the stair step flow path 50 and plurality of flow windows 63 as shown in FIG. 3.

As shown in FIG. 3, when installed, the plural vertically stacked bodies 20 form a plurality of vertically spaced apart and alternating baffles 33 that create a back and forth stair-step type of descent path 50 of flow windows 63 of wastewater/storm water through the medial channel 27. Wastewater/storm water entering the medial channel 27 enters the inlet port 47 and falls generally vertically on to the top surface 33A of the immediately adjacent lower baffle 33. The water then runs, under the influence of gravity and flow characteristics, along the top surface 33A of the first baffle 33 and falls off a terminal edge 33B of the first baffle 33 in a flow window 63. The water then falls vertically onto the top surface 33A of the vertically next lower baffle 33. The process of the water dropping from top 33A of baffle 33 to top 33A of the next lower baffle 33 continues until the water reaches the base unit 34 and exits the medial channel 27 through the outlet port 41 wherein the water flows through the discharge conduit 42 and to the storage cavern (not shown) for storage and later subsequent controlled use and/or treatment.

Our Invention provides a stackable baffle drop shaft body 20 for impeding uncontrolled gravitational flow of water from a first level to a second lower level, comprising: a pre-cast body 20 having a peripheral wall 21 extending thereabout, a top edge 25, a bottom edge 26, an exterior facing surface 21A, an interior facing surface 21B and the pre-cast body 20 defines a medial channel 27 between the top edge 25 and the bottom edge 26; a baffle 33 having a top surface 33A, a bottom surface 33B and a terminal edge 35, the baffle 33 extending inwardly from the interior facing surface 21B of the pre-cast body 20 to at least partially occlude the medial channel 27, and the baffle 33 is positioned relative to the pre-cast body 22 at or below, the top edge 25, or at or above, the bottom edge 26; the top edge 25 and the bottom edge 26 of the pre-cast body 20 each form a portion of a positionally securing engagement and alignment means for positional and vertical alignment and stacking of plural pre-cast bodies 20 on top of one another; and an inlet port 47 defined in a first pre-cast body 20 and communicating between the exterior facing surface 21A and the interior facing surface 21B spacedly above the baffle 33 within the medial channel 27, the inlet port 47 communicating with a source of water proximate the first level; and an outlet port 41 defined in a second pre-cast body 20 and communicating between the interior facing surface 21B and the exterior facing surface 21A, the outlet port 41 communicating with an outlet conduit 42 proximate the second level which is vertically lower than the first level.

A further object of our invention is to provide a stackable baffle drop shaft body 20 for impeding uncontrolled gravitational flow of water from a first level to a second lower level, further comprising a divider wall 60 extending diametrically across the medial channel 27 and between the top edge 25 and the bottom edge 26 dividing the medial channel 27 into a dry side 80 and a wet side 70; and the baffle 33 is on the wet side 70 of the medial channel 27.

A further object of our invention is to provide a stackable baffle drop shaft body 20 for impeding uncontrolled gravitational flow of water from a first level to a second lower level, further comprising plural bodies 20 vertically stacked on top of one another with the bottom edge 26 of a first vertically upper pre-cast body 20 immediately adjacent to and frictionally engaged with a top edge 25 of an immediately adjacent second vertically lower pre-cast body 20 to form a medial channel 27 extending axially through the plural vertically stacked pre-cast bodies 20.

A further object of our invention is to provide a stackable baffle drop shaft body 20 for impeding uncontrolled gravitational flow of water from a first level to a second lower level, further comprising a base unit 34 interconnected to the plural stacked pre-cast bodies 20 at the second level which is vertically lowermost relative to the plural stacked pre-cast bodies 20, the base unit 34 having an integral bottom 40 that fully occludes the medial channel 27; and defining an outlet port 41 for water to exit the baffle drop.

A further object of our invention is to provide a stackable baffle drop shaft body 20 for impeding uncontrolled gravitational flow of water from a first level to a second lower level, wherein the pre-cast body 20 is cast in multiple individual body pieces, each individual body piece having a first end 22, a second end 23, a top edge 25, a bottom edge 26, an exterior facing surface 21A and an interior facing surface 21B, and the plural individual body pieces are interconnected to one another end-to-end to form a single pre-cast body 20 having a peripheral wall 21 extending entirely thereabout and having both an exterior facing surface 21A and an interior facing surface 21B of the peripheral wall 21 and defining the medial channel 27.

A further object of our invention is to provide a stackable baffle drop shaft body 20 for impeding uncontrolled gravitational flow of water from a first level to a second lower level and wherein the pre-cast body 20 is pre-cast in multiple individual pieces off site and the multiple individual pieces are transported to an installation site for assembly and installation.

A further object of our invention is to provide a stackable baffle drop shaft body 20 for impeding uncontrolled gravitational flow of water from a first level to a second lower level and wherein each of the plural pre-cast bodies 20 are substantially identical, and the position of the baffle 33 within the wet side 70 of the medial channel 27 is alternated by inverting each of the plural pre-cast bodies 20 relative to an immediately vertically below pre-cast body 20.

A further object of our invention is to provide a stackable baffle drop shaft body 20 for impeding uncontrolled gravitational flow of water from a first level to a second lower level, further comprising plural pre-cast bodies 20 vertically axially aligned and interconnected with one another, each of the plural pre-cast bodies 20 having a peripheral wall 21 extending entirely thereabout, and each pre-cast body 20 has a top edge 25, a bottom edge 26, an exterior facing surface 21A, an interior facing surface 21B and defines a medial channel 27 between the top edge 25 and the bottom edge 26, so that the plural interconnected pre-cast bodies 20 define a medial channel 27 extending therethrough and therebetween; a top 45 interconnected with the top edge 25 of an uppermost of the plural pre-cast bodies 20, the top 45 substantially completely occluding the medial channel 27 at the top edge 25 of the uppermost pre-cast body 20; a base unit 34 interconnected to the plural vertically stacked pre-cast bodies 20 at a vertically lowermost position relative to the plural stacked pre-cast bodies 20, the base unit 34 having an integral bottom 40 that fully occludes the medial channel 27; a divider wall 60 extending diametrically across the medial channel 27 of each of the plural pre-cast bodies 20 and between the top edge 25 and the bottom edge 26 so as divide the medial channel 27 into a dry side 80 and a wet side 70; worker access apparatus within the medial channel 27 on the dry side 80; a baffle 33 on the wet side 70 of the medial channel 27, the baffle 33 having a top surface 33A, a bottom surface 33B and a terminal edge 35, the baffle 33 extending inwardly from the interior facing 21B surface of the peripheral wall 21 and extending at least partially across the medial channel 27 defined by the pre-cast body 20 to at least partially occlude the medial channel 27, and the baffle 33 is positioned relative to the body 20 at or below, the top edge 25, or at or above, the bottom edge 26; the top edge 25 and the bottom edge 26 of the pre-cast body 20 each form a portion of a positionally securing engagement and alignment means for positional and vertical alignment and stacking of plural pre-cast bodies 20 on top of one another; and an inlet port 47 defined in the body 20 and communicating between the exterior facing surface 21A and the interior facing surface 21B spacedly above the baffle 33 within the medial channel 27, the inlet port 47 communicating with a source of water proximate the first level; and an outlet port 41 defined in the body 20 and communicating between the interior facing surface 21B and the exterior facing surface 21A, the outlet port 41 communicating with an outlet conduit 42 proximate the second level which is vertically lower than the first level.

A further object of our invention is to provide a method for forming a baffle drop assembly comprising the steps: defining a shaft in a supporting ground surface, the shaft having a first level proximate a ground level and proximate a source of water; and a second level vertically lower than the first level, the second level vertically proximate a water storage space, and the shaft having a predetermined interior diameter; establishing a foundation within the shaft at the second level, the foundation being sufficient to operationally support the baffle drop assembly and water to be received therein; providing a base unit 34 of the baffle drop assembly, the base unit 34 having a peripheral wall 21 that extends entirely there-about, and an exterior diameter that is less than the diameter of the defined shaft, the peripheral wall 21 having a top edge 25, a bottom edge 26, an exterior facing surface 21A, an interior facing surface 21B, and the peripheral wall 21 defines a medial channel 27, having an interior diameter that is fully occluded by a bottom 40 of the base unit 34, proximate the bottom edge 26 thereof, the base unit 34 further defining an outlet port 41 that communicates between the interior facing surface 21B and the exterior facing surface 21A proximate the bottom 40 so that water within the base unit 34 flows outwardly through the outlet port 41 which communicates with an outlet conduit 42 that communicates with a fluid storage space; providing a first baffle drop body 20, the first baffle drop body 20 having a peripheral wall 21 that extends entirely there-about, with an exterior diameter that is the same as the exterior diameter of the base unit 34, the peripheral wall 21 having a top edge 25, a bottom edge 26, an exterior facing surface 21A, an interior facing surface 21B, and the peripheral wall 21 defines a medial channel 27 that extends between the top edge 25 and the bottom edge 26, and the bottom edge 26 of the first baffle drop body 20 is aligned with, and positioned immediately adjacent, the top edge 25 of the bottom unit 34, and the first baffle drop body 20 has a generally horizontally and laterally extending baffle 33 extending inwardly from the interior facing surface 21B of the peripheral wall 21 to at least partially occlude the medial channel 27 defined by the first baffle drop body 20, and the first baffle drop body 20 has a diametrically extending divider wall 60 within the medial channel 27 and extending from the top edge 25 to the bottom edge 26 to divide the medial channel 27 into a dry side 80 and a wet side 70, and wherein the baffle 33 is within the wet side 70, and worker access means are within the dry side 80, and securing the bottom edge 26 of the first baffle drop body 20 to the top edge 25 of the base unit 34 in a substantially fluid tight interconnection; providing a second baffle drop body 20 that is substantially identical to the first baffle drop body 20 and inverting the second baffle drop body 20 relative to the first baffle drop body 20, the second baffle drop body 20 having a peripheral wall 21 that extends entirely there-about, with an exterior diameter that is the same as the exterior diameter of the first baffle drop body 20, the peripheral wall 21 having a top edge 25, a bottom edge 26, an exterior facing surface 21A, an interior facing surface 21B, and the peripheral wall 21 defines a medial channel 27 that extends between the top edge 25 and the bottom edge 26, and the bottom edge 26 of the second baffle drop body 20 is aligned with and positioned immediately adjacent the top edge 25 of the first baffle drop body 20, and the second baffle drop body 20 has a generally horizontally and laterally extending baffle 33 extending inwardly from the interior facing surface 21B of the peripheral wall 21 to at least partially occlude the medial channel 27 defined by the second baffle drop body 20, and the second baffle drop body 20 has a diametrically extending divider wall 60 within the medial channel 27 and extending from the top edge 25 to the bottom edge 26 to divide the medial channel 27 into a dry side 80 and a wet side 70, and wherein the baffle 33 is within the wet side 70, and worker access means are within the dry side 80, and securing the bottom edge 26 of the second baffle drop body 20 to the top edge 25 of the first baffle drop body 20 in a substantially fluid tight interconnection, and the baffle 33 carried within the second baffle drop body 20 is both vertically and horizontally offset from the baffle 33 carried within the wet side 70 of the first baffle drop body 20; providing a third baffle drop body 20 that is substantially identical to the second baffle drop body 20 and inverting the third baffle drop body 20 relative to the second baffle drop body 20, the third baffle drop body 20 having a peripheral wall 21 that extends entirely there-about, with an exterior diameter that is the same as the exterior diameter of the second baffle drop body 20, the peripheral wall 21 having a top edge 25, a bottom edge 26, an exterior facing surface 21A, an interior facing surface 21B, and the peripheral wall 21 defines a medial channel 27 that extends between the top edge 25 and the bottom edge 26, and the bottom edge 26 of the third baffle drop body 20 is aligned with and positioned immediately adjacent the top edge 25 of the second baffle drop body 20, and the third baffle drop body 20 has a generally horizontally and laterally extending baffle 33 extending inwardly from the interior facing surface 21B of the peripheral wall 21 to at least partially occlude the medial channel 27 defined by the third baffle drop body 20, and the third baffle drop body 20 has a diametrically extending divider wall 60 within the medial channel 27 and extending from the top edge 25 to the bottom edge 26 to divide the medial channel 27 into a dry side 80 and a wet side 70 wherein the baffle 33 is within the wet side 70, and worker access means are within the dry side 80, and securing the bottom edge 26 of the third baffle drop body 20 to the top edge 25 of the second baffle drop body 20 in a substantially fluid tight interconnection, and the baffle 33 carried within the wet side 70 of the third baffle drop body 20 is both vertically and horizontally offset from the baffle 33 carried within the wet side 70 of the second baffle drop body 20, and the baffle 33 carried within the wet side 70 of the third baffle drop body 20 is vertically and horizontally aligned with the baffle 33 carried within the wet side 70 of the first baffle drop body 20; defining an inlet port 47 in the third baffle drop body 20, the inlet port 47 communicating between the exterior facing surface 21A and the interior facing surface 21B proximate above the baffle 33 so that water at the first level flows through the inlet port 47 and into the medial channel 27 of the third baffle drop body 20 and onto the top surface 33A of the baffle 33, and thereafter the water flows off the terminal edge 35 of the baffle 33 and falls downwardly along a flow window 63 onto the top surface 33A of the adjacent next below baffle 33; providing a top 45 that is releasably interconnected with the top edge 25 of the third baffle drop body 20 proximate the first level, the top 45 having a diameter that is substantially equal to the diameter of the third baffle drop body 20 so that the top 45, when releasably engaged with the third baffle drop body 20 substantially completely occludes the medial channel 27; and back-filling the defined shaft outward of the exterior facing surface 21A of the peripheral wall 21.

The above description has set out various features, functions, methods and other aspects of our invention. This has been done with regard to the currently preferred embodiments thereof. Time and further development may change the manner in which the various aspects are implemented. The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

Having thusly described and disclosed our Stackable Baffle Drop Shaft Unit and Method, we file this Utility Patent Application and respectfully request issuance of Utility Letters Patent.

We claim:

1. A stackable baffle drop shaft unit for impeding uncontrolled gravitational flow of water from a first level to a second lower level, comprising:

a pre-cast body having a peripheral wall extending there-about, a top edge, a bottom edge, an exterior facing surface, an interior facing surface and the pre-cast body defines a medial channel between the top edge and the bottom edge;

a baffle having a top surface, a bottom surface and a terminal edge, the baffle extending inwardly from the interior facing surface of the pre-cast body to at least partially occlude the medial channel, and the baffle is positioned relative to the pre-cast body at or below, the top edge, or at or above, the bottom edge;

the top edge and the bottom edge of the pre-cast body each form one half of a positionally securing engagement and alignment means for positional and vertical alignment and stacking of plural pre-cast bodies on top of one another; and an inlet port defined in a first pre-cast body and communicating between the exterior facing surface and the interior facing surface spacedly above the baffle within the medial channel, the inlet port communicating with a source of water proximate the first level; and an outlet port defined in a second pre-cast body and communicating between the interior facing surface and the exterior facing surface, the outlet port communicating with an outlet conduit proximate the second level which is vertically lower than the first level; and further comprising:

plural bodies vertically stacked on top of one another with the bottom edge of a first vertically upper pre-cast body immediately adjacent to and frictionally engaged with a top edge of an immediately adjacent second vertically lower pre-cast body to form a medial channel extending axially through the plural vertically stacked pre-cast bodies; and wherein each of the plural pre-cast bodies may be assembled from plural individual pieces that may be cast off-site and thereafter transported to an installation site for assembly, to form plural substantially identical pre-cast bodies, and the position of the baffle within a wet side of the medial channel is alternated by inverting each of the plural pre-cast bodies relative to the immediately vertically below pre-cast body.

2. The stackable baffle drop shaft unit of claim 1 and further, comprising:

a divider wall extending diametrically across the medial channel and between the top edge and the bottom edge dividing the medial channel into a dry side and a wet side; and the baffle is on the wet side of the medial channel.

3. The stackable baffle drop shaft unit of claim 1 and further, comprising:

a top interconnected with the top edge of the uppermost pre-cast body, the top substantially completely occluding the medial channel at the top edge of the uppermost pre-cast body.

4. The stackable baffle drop shaft unit of claim 1 and further, comprising:

a base unit interconnected to the plural stacked pre-cast bodies at a vertically lowermost position relative to the plural stacked pre-cast bodies, the base unit having an integral bottom that fully occludes the medial channel; and defining an outlet port for water to exit the baffle drop.

5. The stackable baffle drop shaft unit of claim 1 and wherein the pre-cast body is cast in multiple individual body pieces, each individual body piece having a first edge and a spaced apart second edge, and the plural individual body pieces are interconnected to one another edge-to-edge to form a single pre-cast body having a peripheral edge extending entirely thereabout and having both the exterior facing surface and the interior facing surface of the peripheral wall and defining the medial channel.

6. The stackable baffle drop shaft unit of claim 1 and wherein the pre-cast body is cast as a single piece off site and is transported to an installation site.

7. The stackable baffle drop shaft unit of claim 1 and wherein the pre-cast body is annular in peripheral configuration.

8. The stackable baffle drop shaft unit of claim 1 and wherein the body is polygonal in peripheral configuration.

9. The stackable baffle drop shaft unit of claim 1 and further, comprising:

worker access apparatus within a dry side of the medial channel.

10. The stackable baffle drop shaft unit of claim 1 and wherein the plural pre-cast bodies are installed subsurface.

11. The stackable baffle drop shaft unit of claim 1 and wherein the baffle is horizontal and parallel to the top edge and the bottom edge of the pre-cast body.

12. A method for forming a baffle drop assembly comprising the steps:

defining a shaft in a supporting ground surface, the shaft having a first level proximate a ground level and proximate a source of water; and a second level vertically lowerthan the first level, the second level vertically proximate a water storage space, and the shaft having a predetermined interior diameter;

establishing a foundation within the shaft at the second level, the foundation being sufficient to operationally support the baffle drop assembly and water to be received therein;

providing a base unit of the baffle drop assembly, the base unit having a peripheral wall that extends entirely there-about, and an exterior diameter that is less than the diameter of the defined shaft, the peripheral wall having a top edge, a bottom edge, an exterior facing surface, an interior facing surface, and the peripheral wall defines a medial channel, having an interior diameter that is fully occluded by a bottom of the base unit, proximate the bottom edge thereof, the base unit further defining an outlet port that communicates between the interior facing surface and the exterior facing surface proximate the bottom so that water within the base unit flows outwardly through the outlet port which communicates with an outlet conduit that communicates with a fluid storage space;

providing a first baffle drop body, the first baffle drop body having a peripheral wall that extends entirely there-about, with an exterior diameter that is the same as the exterior diameter of the base unit, the peripheral wall having a top edge, a bottom edge, an exterior facing surface, an interior facing surface, and the peripheral wall defines a medial channel that extends between the top edge and the bottom edge, and the bottom edge of the first baffle drop body is aligned with, and positioned immediately adjacent, the top edge of the bottom unit, and the first baffle drop body has a generally horizontally and laterally extending baffle extending inwardly from the interior facing surface of the peripheral wall to at least partially occlude the medial channel defined by the first baffle drop body, and the first baffle drop body has a diametrically extending divider wall within the medial channel and extending from the top edge to the bottom edge to divide the medial channel into a dry side and a wet side, and wherein the baffle is within the wet side, and worker access means are within the dry side, and securing the bottom edge of the first baffle drop body to the top edge of the base unit in a substantially fluid tight interconnection;

providing a second baffle drop body that is substantially identical to the first baffle drop body and inverting the second baffle drop body relative to the first baffle drop body, the second baffle drop body having a peripheral wall that extends entirely there-about, with an exterior diameter that is the same as the exterior diameter of the first baffle drop body, the peripheral wall having a top edge, a bottom edge, an exterior facing surface, an interior facing surface, and the peripheral wall defines a medial channel that extends between the top edge and the bottom edge, and the bottom edge of the second baffle drop body is aligned with and positioned immediately adjacent the top edge of the first baffle drop body, and the second baffle drop body has a generally horizontally and laterally extending baffle extending inwardly from the interior facing surface of the peripheral wall to at least partially occlude the medial channel defined by the second baffle drop body, and the second baffle drop body has a diametrically extending divider wall within the medial channel and extending from the top edge to the bottom edge to divide the medial channel into a dry side and a wet side, and wherein the baffle k within the wet side, and worker access means are within the dry side, and securing the bottom edge of the second baffle drop body to the top edge of the first baffle drop body in a substantially fluid tight interconnection, and the baffle carried within the second baffle drop body is both vertically and horizontally offset from the baffle carried within the wet side of the first baffle drop body;

providing a third baffle drop body that is substantially identical to the second baffle drop body and inverting the third baffle drop body relative to the second baffle drop body, the third baffle drop body having a peripheral wall that extends entirely there-about, with an exterior diameter that is the same as the exterior diameter of the second baffle drop body, the peripheral wall having a top edge, a bottom edge, an exterior facing surface, an interior facing surface, and the peripheral wall defines a medial channel that extends between the top edge and the bottom edge, and the bottom edge of the third baffle drop body is aligned with and positioned immediately adjacent the top edge of the second baffle drop body, and the third baffle drop body has a generally horizontally and laterally extending baffle extending inwardly from the interior facing surface of the peripheral wall to at least partially occlude the medial channel defined by the third baffle drop body, and the third baffle drop body has a diametrically extending divider wall within the medial channel and extending from the top edge to the bottom edge to divide the medial channel into a dry side and a wet side wherein the baffle is within the wet side, and worker access means are within the dry side, and securing the bottom edge of the third baffle drop body to the top edge of the second baffle drop body in a substantially fluid tight interconnection, and the baffle carried within the wet side of the third baffle drop body is both vertically and horizontally offset from the baffle carried within the wet side of the second baffle drop body, and the baffle carried within the wet side of the third baffle drop body is vertically and horizontally aligned with the baffle carried within the wet side of the first baffle drop body;

defining an inlet port in the third baffle drop body, the inlet port communicating between the exterior facing surface and the interior facing surface proximate above the baffle so that water at the first level flows through the inlet port and into the medial channel of the third baffle drop body and onto the top surface of the baffle, and thereafter the water flows off the terminal edge of the baffle and falls downwardly along a flow window onto the top surface of the adjacent next below baffle;

providing a top that is releasably interconnected with the top edge of the third baffle drop body proximate the first level, the top having a diameter that is substantially equal to the diameter of the third baffle drop body so that the top, when releasably engaged with the third baffle drop body substantially completely occludes the medial channel; and back-filling the defined shaft outward of the exterior facing surface of the peripheral wall.

* * * * *